United States Patent [19]

Dilot et al.

[11] 4,372,797

[45] Feb. 8, 1983

[54] METHOD FOR THE APPLICATION OF SUCTION TUBES TO PACKING CONTAINERS

[75] Inventors: Rolf M. Dilot, Lund; Jan T. Hakansson, Eslöv, both of Sweden

[73] Assignee: Tetra Pak International AB, Lund, Sweden

[21] Appl. No.: 269,915

[22] Filed: Jun. 2, 1981

Related U.S. Application Data

[62] Division of Ser. No. 5,903, Jan. 28, 1979, Pat. No. 4,293,369.

[51] Int. Cl.[3] ..... B65B 19/34

[52] U.S. Cl. ..... 156/249; 53/410

[58] Field of Search ..... 53/410, 415; 156/249, 156/292, 521, 566

[56] References Cited

U.S. PATENT DOCUMENTS

| | | | |
|---|---|---|---|
| 2,013,475 | 9/1935 | Orton | 206/229 |
| 2,107,311 | 2/1938 | Strickler | 156/566 X |
| 2,936,921 | 5/1960 | Schulz | 156/568 |
| 2,956,612 | 10/1960 | Gaines et al. | 156/521 X |
| 3,189,171 | 6/1965 | Miller | 206/229 |
| 3,523,052 | 8/1970 | Bolen | 156/521 |
| 3,812,572 | 5/1974 | Weikert | 53/410 X |
| 3,851,441 | 12/1974 | Marchand | 53/133 X |
| 4,233,331 | 11/1980 | Lemke et al. | 156/521 X |

*Primary Examiner*—Henry F. Epstein

[57] ABSTRACT

A method for the application of suction tubes to packing containers is disclosed. Portion-sized packages for juice and the like are often equipped with suction tubes to facilitate the emptying thereof. The suction tubes, which for reasons of hygiene are individually wrapped in paper, are very light and therefore difficult to handle and to attach to the outside surface of the packing container by mechanical means.

The wrapped tubes are separated from a continuous band while an adhesive is applied to the containers. The containers and tubes ae oriented in relation to each other and then the tubes are attached to the containers.

4 Claims, 2 Drawing Figures

METHOD FOR THE APPLICATION OF SUCTION TUBES TO PACKING CONTAINERS

This is a division, of application Ser. No. 5,903, filed Jan. 23, 1979 now U.S. Pat. No. 4,293,369.

BACKGROUND OF THE INVENTION

The present invention relates to a method for the application of suction tubes or drinking straws to prefabricated packing containers which suction tubes are wrapped in protective casings and are arranged so as to be supplied to the machine in the form of a continuous band.

Fruit juices and the like at present are frequently packed of non-returnable packages in portion-size which are intended to be emptied with the help of a suction tube. The suction tube for reasons of hygiene is usually wrapped in a protective paper or a protective casing and is supplied together with the package, either separately or joined in one way or another to the packing container.

The suction tube or the suction tube casing may be attached for example by means of tape or the like to the outside of the packing container.

The attachment of each individually wrapped suction tube to the wall surface of the packing container had to be carried out hitherto mainly by hand, since the mechanical handling of the very light suction tube was found to cause great difficulties. The mechanical handling can be made easier, however, if the suction tubes, after they have been enclosed in the individual casing, are joined together in such a manner that a continuous band of suction tubes is formed. The individually wrapped suction tubes are separated from this band only in connection with the application to the individual packing containers. This concept is described in detail in Swedish patent No. 7613372-7, to which reference is made.

It is an object of the present invention to provide a machine for the application of suction tubes to prefabricated packing containers. It is presumed that the suction tubes are wrapped in protective casings and arranged so as to be supplied to the machine in the form of a continuous band as described in the said Swedish patent application, that is to say, the wrapped, individual suction tubes are fixed along two preferably parallel carrier bands in such a manner that the suction tubes are arranged parallel with one another at equal mutual distances.

This object has been achieved in accordance with the present invention in that a machine of the type described earlier is adapted so as to separate suction tubes from the suction tube band, orientate the suction tubes and the packing containers in the correct position relative to one another and with the help of an adhesive attach the suction tubes to the packing containers.

In a preferred embodiment of the machine in accordance with the invention the machine includes a feed track for the packing containers and a driving mechanism for the suction tube band arranged adjoining the feed track, the feed track and the driving mechanism comprising devices for the mutual orientation of the packing containers and the suction tubes respectively.

In a further embodiment of the machine in accordance with the present invention the feed track for the packing containers is constituted of individual packing container carrier elements joined together to form an endless chain, which elements in a part of their course of travel are adapted so as to be oriented to allow the application of suction tubes in the desired position to the packing containers.

In a further embodiment of the machine in accordance with the invention the packing container carrier elements for substantially parallelepipedic packing containers are adapted so as to be pivoted to such a position that the suction tube can be attached substantially diagonally over one of the side faces of the packing containers.

In a further embodiment of the machine in accordance with the present invention the driving mechanism for the suction tube has the form of a rotatable element provided with peripheral recesses, along the periphery of which are arranged devices for the separation of the suction tubes from the band, orientation of the separated suction tubes and transfer of the suction tubes to and pressing of the suction tubes against the packing containers.

In a further embodiment of the machine in accordance with the present invention the device for the separation of the suction tubes from the band is constituted of a reciprocating knife element which during its working stroke, in co-operation with a hold-on arranged on the driving mechanism, separates a suction tube from the continuous band.

Finally, in a further embodiment of the machine in accordance with the present invention the device for the orientation of the cut-off suction tube comprises sliding surfaces located along the periphery of the driving mechanism, which by acting upon the end surfaces of the suction tubes located in the recesses axially move the suction tubes to the correct position in relation to the packing containers.

BRIEF DESCRIPTION OF THE DRAWING

A preferred embodiment of the machine in accordance with the present invention will now be described in detail with special reference to the enclosed schematic drawings.

DETAILED DESCRIPTION OF THE INVENTION

Figure 1:
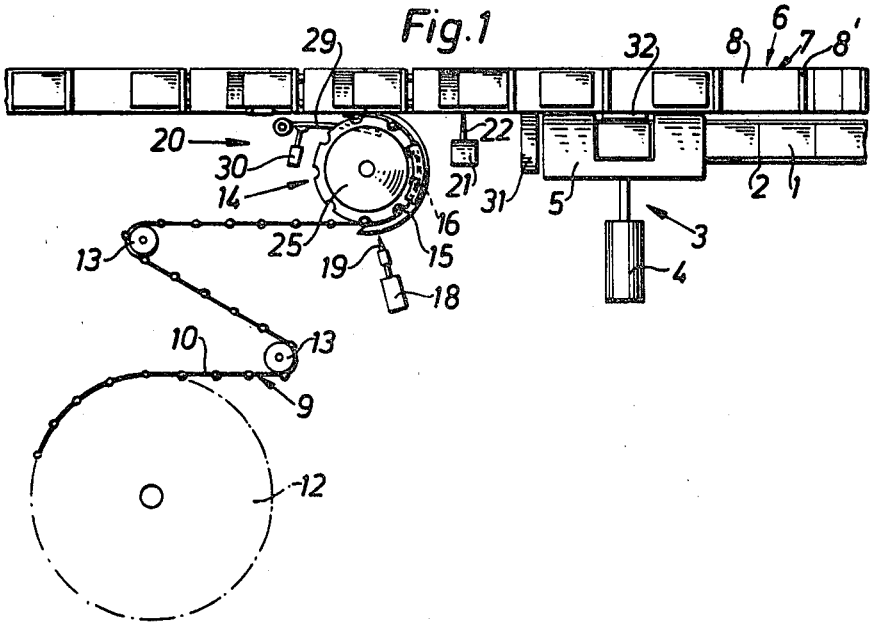
FIG. 1 shows a plan view of a machine in accordance with the invention wherein only the parts necessary for an understanding of the invention have been included.

Prefabricated parallelepipedic packing containers 1 are supplied to the machine for the application of suction tubes by means of a conveyor belt 2 which conveys the packing containers 1 to a transfer unit 3. The transfer unit comprises a U-shaped transfer element 5 driven by means of a piston and cylinder unit 4 which successively transports packing containers 1 to a feed track 6. The feed track 6 has the form of an endless chain of packing container carrier elements 7 joined to one another.

The packing container carrier elements 7 are L-shaped with a first leg 8 situated substantially horizontally and a second substantially vertical leg 8' at the rear edge of the first leg 8, seen in the direction of movement of the feed track 6 from right to left in FIG. 1. The packing container elements are arranged so that during their movement along the track they assume on the one hand a first position, wherein the first leg 8 of the packing container carrier element is parallel with the direction of the track, and on the other hand a second position, wherein the said leg 8 assumes a predetermined angle with the plane of movement. More particularly, the packing container carrier elements 7 are arranged so that during the movement of the feed track 6 from right to left they assume the said first position with a leg 8 parallel with the plane of movement at the right end of the track seen on the drawing, that is to say, while the respective packing container carrier element 7 passes close to the transfer unit 3 for packing containers. During the movement towards the left on the drawing the individual packing container elements 7 are rotated successively to the said second position in that the leg 8, originally arranged parallel with the plane of movement, is successively lifted so that it assumes an angle of preferably 30° with the plane of movement when the respective packing container carrier element passes a point where the transported packing container is provided with a suction tube.

The suction tubes to be applied to the prefabricated packing containers by means of the machine in accordance with the present invention are supplied to the machine in the form of a continuous band 9 of suction tubes wrapped in individual protective casings 10. The suction tube band 9 consists of two parallel carrier bands 11 (FIG. 2) along which the suction tubes wrapped in the said protective casings 10 are arranged parallel with one another at equal mutual distances. The suction tube band 9 is supplied to the machine in the form of a magazine roll 12 which is arranged in the machine so that it can freely rotate. The suction tube band 9 is guided via pulleys 13 to a driving mechanism for the suction tube band, which driving mechanism is rotatable and is adapted so as to feed the suction tubes to a point at which they are transferred to and fixed onto the packing containers. Along the periphery of the driving mechanism there is a guide rail 15, upper and lower orientation devices 16 and 17 respectively, a knife element 19 actuated by a piston and cylinder unit 18 and a transfer element 20.

Finally, FIG. 1 also shows an adhesive applicator 21 which is located adjoining the feed track 6 and is adapted so as to apply adhesive, e.g. of the "hot-melt" type, by means of two nozzles 22 (only one of which is shown in FIG. 1) to the side face of the packing container to which the suction tube is to be attached.

Figure 2:
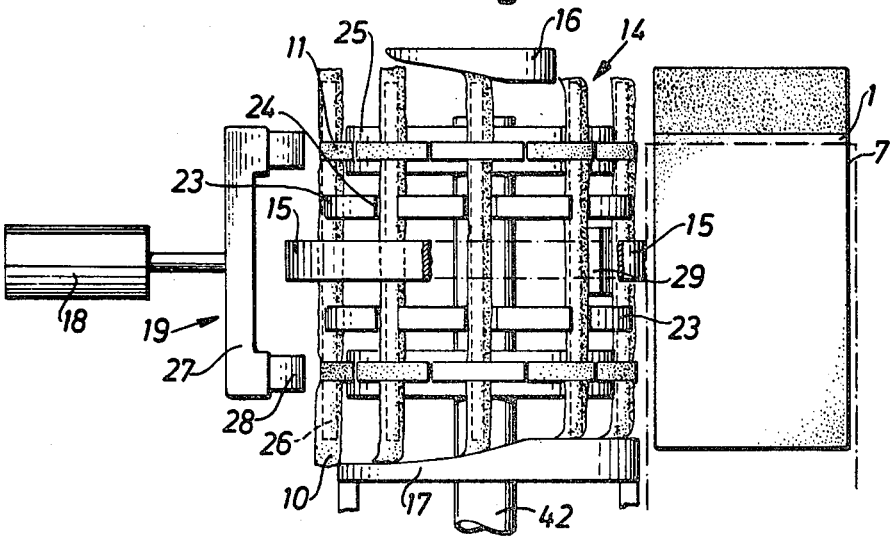
FIG. 2 is a lateral view of a part of the machine in accordance with the invention.

FIG. 2 shows in a side view and on a larger scale the driving mechanism 14 for the suction tube band and surrounding elements, with some elements, however, having been wholly or partly left out for the sake of greater clarity and so as to facilitate understanding of the invention. More particularly, FIG. 2 illustrates how the driving mechanism 14 for the suction tube band comprises a central axle 42 which is rotatable and is driven by means of a motor, not shown on the drawing. The axle 42 carries two parallel, toothed wheels 23 located at some distance from one another which consist substantially of cylindrical discs in the periphery of which recesses 24 for suction tubes are provided. At some distance from the toothed wheels 23 the axle 42 carries two further disc-shaped elements 25 which are parallel with one another as well as with the toothed wheels 23. These two disc-shaped elements 25 have a substantially cylindrical outer surface and serve as a hold-on for the knife element 19 which will be described in more detail in the following. The mutual location on the axle 42 of the two toothed wheels 23 and the two disc-shaped elements 25 serving as a hold-on may be adapted so as to be fully matched to the type of suction tube band 9 used on the particular occasion.

The suction tube band 9, as partly described earlier, comprises two mutually parallel carrier bands 11 located at a distance from one another which may be made of plastics, paper or some other suitable material. In FIG. 2 the carrier band 11 is shown at the same level as the two cylindrical discs 25 serving as a hold-on, but the visible portion of the carrier band 11 has already been divided with the help of the knife element 19. Suction tubes or drinking straws 26 wrapped in protective casings 10 are arranged at equal distances along the two carrier bands 11. As can be seen from the Figure, the carrier band is joined only to the protective casings 10, so that the suction tubes 26 can move freely in longitudinal direction inside the protective casings. The distance between the recesses 24 in the two toothed wheels 23 is of course matched to the distance between the suction tubes contained in the suction tube band 9. The suction tube band or the suction tubes are retained in position in the recesses 24 with the help of the guide rail 15 which in semi-circular shape extends along the periphery of the driving mechanism 14.

Along the periphery of the driving mechanism 14 also extend the two fixed orientation devices, namely the upper orientation device 16 and the lower orientation device 17 which are provided with sliding surfaces facing each other, and which come closer together seen in the direction of movement of the suction tubes from left to right in FIG. 2, the smallest distance between the sliding surfaces substantially coinciding with or slightly exceeding the length of the suction tubes.

The knife element 19 is shown in greater detail in FIG. 2 and comprises a yoke 27 which can be given a reciprocating movement by means of a piston and cylinder unit 18. The yoke carries two knives 28 arranged at a distance from each other which are at the same level as the upper and lower carrier band 11 respectively and are adapted so that during the working stroke of the piston and cylinder unit 18 they are displaced so as to make contact with the hold-on 25, as a result of which the carrier band 11 will be cut off in the recesses between suction tubes.

Partly obscured by the driving mechanism 14 in FIG. 2 the pivotable arm 29 of the transfer element 20 can also be seen, whose free end extends between the two toothed wheels 23. The arm 29 is adapted so that it is maneuvered between the first position shown in FIG. 1 to a position resting against a side of the packing containers with the help of a piston and cylinder unit 30.

In FIG. 2 is also shown how a packing container 1 with the help of the carrier element 7 indicated is in a position directly adjoining the driving mechanism for the suction tube band.

The machine in accordance with the present invention, beside the parts shown in the Figures, comprises a number of elements for the control and driving of the machine. These elements, which e.g. comprise a photocell unit for monitoring the position of the packages, electric control devices, driving elements in the form of electric motors, power-transmitting elements, etc, are however, conventional and well-known to those versed in the art and have therefore together with the foundations of the machine, been left out of the description and drawings.

When the machine in accordance with the invention is operated the packing container 1 is passed by means of the conveyor belt 2 to the transfer unit 3, the transfer element 5 being in its withdrawn, inactive position thus allowing the row of packing containers to be displaced until the front package comes into contact with a stop 31. In this position the piston and cylinder unit 4 of the transfer unit 3 is actuated and the transfer element 5 is displaced from its withdrawn rest position shown in FIG. 1 when the first and the third packing container in the row of packing containers on the conveyor belt 2 are moved in lateral direction each one to its packing container carrier element 7 in the feed track 6. The packing container located in between is stopped by a stop 32 and follows instead in the next working stroke when it is advanced by the conveyor belt 2 until it makes contact with the stop 31.

After transfer to the feed track 6 the packing containers 1 are moved on the respective packing container element 7 towards the left in FIG. 1, when at the same time the first leg 8 of the packing container carrier element is raised at an angle to the horizontal plane until the packing container carrier element assumes such a position that the diagonal line of the packing container side is substantially vertical. The packing container, having been placed in this position, approaches the adhesive applicator 21 whose two nozzles 22 arranged above one another provide the side face of the packing container facing the applicator 21 with two dabs of hot-melt which are placed on two diagonally opposite corners of the side wall of the packing container. Then the packing container, which like the packing container carrier element 7 retains the same angular position until it is straight before the driving mechanism 14, is moved as shown in FIG. 2.

During the operation of the machine the suction tube band 9 is fed by the driving mechanism 14 from the magazine roll 12 via pulleys 13 to the driving mechanism 14 where the wrapped suction tubes are made to engage with recesses 24 in the toothed wheels 23. The guide rail 15 is situated at such a distance from the driving mechanism 14 that the suction tubes, having properly assumed their position in the recesses 24, cannot leave the recesses until they have passed, the end of the guide rail 15 located in the vicinity of the packing container owing to the rotation of the driving mechanism 14.

The driving mechanism 14 rotates intermittently anticlockwise in FIG. 1 in step with the intermittent movement of the feed track 6 and moves the suction tubes with the associated suction tube casing and carrier band along the guide rail 15. The suction tubes 26 first reach the knife element 19 which separates one at a time from the continuous suction tube band 9. More particularly, the knife element 19 with the two knives performs a reciprocating movement consisting of working and return stroke, the movement being so synchronized with the intermittent rotation of the driving mechanism 14 that the knives, in co-operation with the hold-on 25, in each working stroke separate the carrier band 11 between two successive suction tubes.

On continued rotation of the driving mechanism 14 the suction tube separated from the suction tube band 9 will then come to be located between the two orienting devices 16 and 17. On contact with the sliding surfaces of the orienting devices 16 and 17 the flexible suction tube casing 10 will successively be folded sideways and gradually both end surfaces of the suction tube itself will come into contact with the sliding surfaces. Since the suction tube is so arranged inside the suction tube casing that it is axially displaceable, the suction tube is now shifted axially while a certain displacement of the casing and of the parts of the carrier band 11 connected to the casing also takes place, so that the position in vertical sense of the suction tube is accurately defined. The suction tube retains this vertical position during its subsequent movement until it has been attached to the packing container 1.

When the orientation in a vertical sense has been completed, the suction tube has been moved to a position between the driving mechanism 14 and the packing container 1 located adjoining the driving mechanism, whereby the suction tube at the same time has passed the front end of the arm 29 of the transfer element 20, which is illustrated most clearly in FIG. 1. The transfer element 20 is now activated and the arm 29 is pivoted with the help of the piston and cylinder unit 30 in a quick movement from the rest position shown in FIG. 1 to a position in contact with the side face of the packing container 1, whereby the suction tube is moved out of the recess 24 in the driving mechanism 14 and to the side of the packing container facing the driving mechanism, to which side the suction tube casing 10 is attached with the help of the dabs of adhesive applied earlier. The arm 29 of the transfer element 20 then immediately returns to the rest position. The attachment of the suction tube to the side face of the packing container has thus been completed, and the packing containers provided with suction tube are moved subsequently with the help of the feed track 6 out of the machine in accordance with the invention e.g. to be packed in collective containers or the like.

The machine described preferably operates intermittently with the packing containers as well as the suction tubes being moved stepwise between the different operative positions. However, the machine can also be operated semi-intermittently with the movement being continuous but the speed being varied so that the packing containers as well as the suction tubes are moved at high speed between the working position and at low speed in the vicinity of the actual working positions. In this manner the capacity of the machine can be somewhat raised which is done, however, at the expense of accuracy in the placing of the suction tubes on the packing containers.

The principles, preferred embodiments and modes of operation of the present invention have been described in the foregoing specification. The invention which is intended to be protected herein should not be construed as limited to the particular forms disclosed, since these are to be regarded as illustrative rather than restrictive. Variations and changes may be made by those skilled in the art without departing from the spirit of the present invention.

What is claimed is:

1. A method for the application of suction tubes, wrapped in protective casings and arranged in the form of a continuous band, to packing containers, comprising:

conveying a plurality of packing containers toward a suction tube applicator station;

orienting the packing containers at an angle to a path of conveyance of the packing containers;

applying an adhesive to a wall of each of the packing containers;

conveying a plurality of suction tubes in the continuous band toward said suction tube applicator station;

separating individual suction tubes from the continuous band;

orienting said individual suction tubes with respect to the packing containers; and attaching said individual suction tubes to the packing containers at said suction tube applicator station by contacting the protective casing of each of said individual suction tubes with said adhesive on said wall of a respective one of the packing containers.

2. The method of claim 1 wherein the angle is an acute angle to a path of travel of the packing containers.

3. The method of claim 1 further comprising the step of intermittently actuating a transfer unit to sequentially transfer a plurality of packing containers from a first conveyor to a second conveyor wherein the second conveyor conveys the plurality of packing containers toward the suction tube applicator.

4. The method of claim 3 wherein the second conveyor includes a plurality of L-shaped packing container carrier elements each having a first, normally horizontal, leg and a second, normally vertical, leg wherein, during the step of orienting the packing containers, each element is pivoted so that its first leg is at an acute angle to the path of conveyance whereby the packing container held on the element is also placed at an acute angle.

* * * * *